United States Patent [19]

Dollenmayer

[11] 4,197,022

[45] Apr. 8, 1980

[54] MULTIPLE SPOKED WHEEL PRINTER

[75] Inventor: William L. Dollenmayer, Versailles, Ky.

[73] Assignee: International Business Machines Corporation, Armonk, N.Y.

[21] Appl. No.: 964,569

[22] Filed: Nov. 29, 1978

[51] Int. Cl.[2] ..... B41J 1/30

[52] U.S. Cl. ..... 400/144.2; 400/149

[58] Field of Search ..... 400/144.1–144.4, 400/149–151, 171, 174; 101/93.11, 93.17–93.19

[56] References Cited

U.S. PATENT DOCUMENTS

| | | | |
|---|---|---|---|
| 1,156,226 | 10/1915 | Herz | 400/144.3 X |
| 3,892,303 | 7/1975 | Willcox | 400/151 X |
| 4,026,403 | 5/1977 | Inose et al. | 400/144.2 X |
| 4,069,907 | 1/1978 | Isobe et al. | 400/144.2 |
| 4,106,611 | 8/1978 | Suzuki et al. | 400/144.2 |
| 4,126,400 | 11/1978 | Suzuki et al. | 400/144.2 |

FOREIGN PATENT DOCUMENTS

| | | | |
|---|---|---|---|
| 2132345 | 1/1972 | Fed. Rep. of Germany | 400/144.2 |

OTHER PUBLICATIONS

Xerox Disc. Journal, "Impact Printer with Dual On--Line Wheels", by D. E. Braun, vol. 1, No. 11/12, Nov./Dec., 1976, p. 35.

*Primary Examiner*—Paul T. Sewell
*Attorney, Agent, or Firm*—John W. Girvin, Jr.

[57] ABSTRACT

Two coaxially mounted spoked print wheels form a single printing element of a serial printer. Each wheel contains plural spokes having print characters thereon and a selected spoke is driven by a hammer to impact paper on a platen thereby effecting printing. Each wheel has a gap or window between two spokes of sufficient size to allow hammer or spoke entry. In operation, the window of one wheel and the selected spoke of the other wheel are rotated to the print position. The hammer is actuated to effect printing. The distance between the hammer and the selected spoke is maintained constant when shifting from wheel to wheel by shifting the wheel combination axially along its axis of rotation. The printing element is advanced relative to the platen and the platen is indexed to effect serial line printing. The two print wheels can readily be removed as a unit from the printer and replaced for type style interchangeability.

20 Claims, 10 Drawing Figures

MULTIPLE SPOKED WHEEL PRINTER

BRIEF BACKGROUND OF THE INVENTION

1. Field

This invention relates to an improved spoked print wheel serial printer or typewriter and more particularly, to one having plural spoked wheels and a single print hammer.

2. Description of the Prior Art

Prior art serial printers have included those incorporating a spoked wheel print element. The wheel is rotated to effect placement of a desired character bearing spoke at a print position. A print hammer is thereafter actuated to drive the selected spoke against a print ribbon and paper located on a platen to effect character printing. The wheel, wheel drive system and hammer are usually mounted upon a carrier which is horizontally advanced along the print line for serially printing characters. Such printers often are associated with character selection keyboards and form a typewriter when so combined. When used as a typewriter, approximately one hundred different print characters are located on the print wheel and may be selected from keyboard operation. Such print wheels are typically 7–9 centimeters in diameter, a dimension governed in part by the number of characters.

Often, it is necessary to type special characters such as, for example, Greek symbols or scientific symbols when preparing documents. When such symbols are desired, the typist must change the print element or print wheel to one which includes such symbols. The print element is thereafter changed when keyboarding normal text. When the printer is used in conjunction with a storage device, the print wheel must be changed during automatic playout operation. It would thus be desirous to include additional special characters or character sets on the same print wheel. However, each character spoke added to the print wheel causes the diameter of the wheel to be increased in order to spacially accommodate the added character spoke. As the wheel diameter is increased, its inertia is increased thereby requiring more expensive and heavier wheel selection drive systems. Further, the carrier drive systems become heavier in order to move the increased weight of the wheel drive selection system. Additionally, more characters result in slower character access times and a resultant speed decrease of the printer, particularly when used in an automatic playout mode. Further, as more characters are added, the character selection logic and drive system become more complex and expensive.

A further desirable typewriter feature is the ability to print exceptionally large characters which are used, for example, when preparing bulletin board notices, speeches to be read, or documents for the visually impaired. Large characters require large space occupancy on the print wheel again resulting in increased diameter wheels with the resultant disadvantages of added weight, added inertia, slower selection speed and increased costs as previously described.

SUMMARY

In order to overcome the above noted shortcomings of the prior art and to provide a wheel printer capable of printing characters selected from a large character set and/or characters of large physical size without appreciably slowing the printing process or adding excessive weight and costs, the present invention provides coaxially mounted plural print wheels forming a single print element with nearly twice the character capacity of a single wheel printer and having approximately the same wheel inertia. Accordingly, it is an object of the invention to provide a print wheel element having additional character capacity without appreciably adding to the inertia of the print wheel element. It is a further object of the invention to provide a printer having large character capacity without appreciably slowing printer operations when printing standard text characters. It is a still further object of the invention to provide a printer having a print wheel of large capacity which may readily be removed from the printer and replaced with a similar wheel having different characters thereon.

The foregoing and other features and advantages of this invention will be apparent from the following more particular description of the preferred embodiment of the invention as illustrated in the accompanying drawing.

IN THE DRAWING

DESCRIPTION

Figure 1:
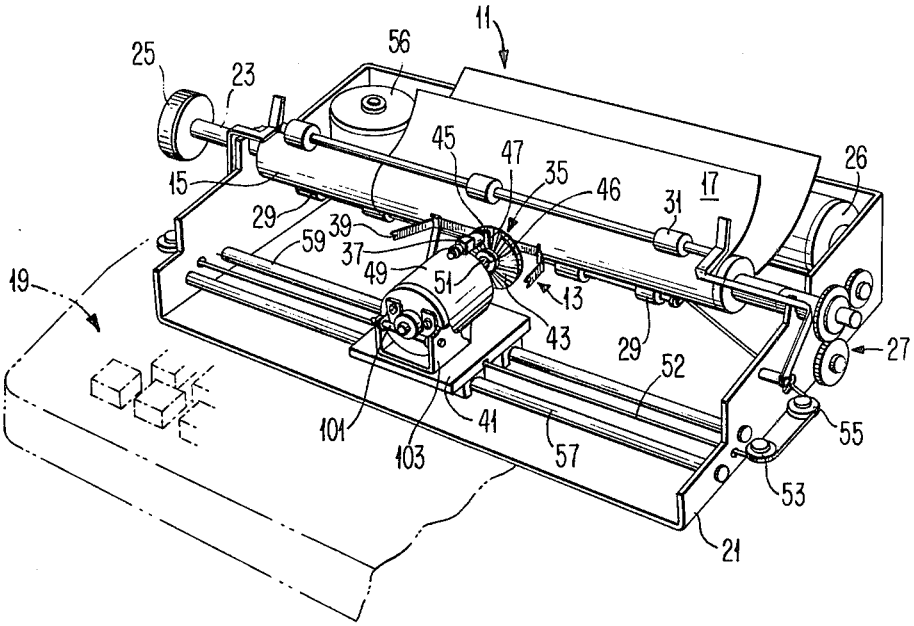
FIG. 1 is a perspective sketch of a typewriter/printer including the multiple spoked wheel print mechanism of the present invention.

Referring now to the drawing, and more particularly to FIG. 1 thereof, a perspective sketch of a typewriter/-printer including the multiple spoked wheel print mechanism of the present invention is depicted. Typewriter/-printer 11 includes a print mechanism 13 and a cylindrical platen 15 about which a print receiving medium such as a sheet of paper 17 may be wrapped to receive printing thereon from the printing mechanism 13. The typewriter/printer 11 may also include a keyboard 19 which may be attached to the front portion of the frame 21. The frame 21 supports the platen shaft 23 which in turn supports the platen 15 about its central axis. The platen may be rotated manually upon rotation of the platen knob 25 or automatically by a drive motor 26 connected to gear train 27. Paper feed rolls 29 are located on the underside of the platen 15 and are spring loaded thereagainst so that the rotary motion of the platen advances the sheet 17 in an upward direction. Conventional paper bails 31 cause the sheet to follow the contour of the platen to further facilitate printing thereon.

The printing mechanism 13 comprises a print element 35, a print hammer mechanism 37 and a print ribbon 39, all of which are mounted to a print element carrier 41. The print element 35 includes a front print wheel 43 and a rear print wheel 45 each including a plurality of print spokes extending radially from a hub 46. Each of the spokes carries a type symbol or character (not shown) thereon. The front print wheel 43 has a window or gap 47 through which the hammer mechanism 37 passes to strike a print spoke of the rear print wheel 45.

When printing from the rear print wheel 45, the front print wheel 43 is positioned so that its gap 47 aligns with the print hammer mechanism 37. The rear print wheel 45 is rotated by a selection motor 49 until the spoke carrying the desired type symbol aligns with the print hammer mechanism 37, gap 47 and the print position on the paper 17. The print hammer mechanism 37 is then actuated to cause the hammer (not shown) to travel a fixed distance through the gap 47 to drive the selected print spoke of the rear print wheel 45 into the print ribbon 39 and thence into the paper 17 to thereby impact the paper 17 with the selected type symbol creating an ink image.

When printing from the front print wheel 43, a gap (not shown) in the rear print wheel 45 is aligned with the print hammer mechanism 37 and the desired character on the front print wheel 43 is positioned adjacent to the print hammer mechanism 37, to the rear print wheel gap (not shown) and to the print position. The hammer then drives the selected print spoke through the gap of the rear print wheel 45 causing it to strike the print ribbon 39 and paper 17 to create an image. As will be subsequently described, the print element 35 is shifted on the print shaft 51 of the selection motor 49 whenever a different print wheel is selected in order to keep the distance traveled by the print hammer and print spoke to the paper constant.

As each character is printed, the print element carrier 41 is spaced or escaped to the next subsequent print position so that a line of printing may be serially created. The cable 52 is secured to the print element carrier 41 and wound about pulleys 53 and 55 and thence connected to a drive motor 56 which effects displacement of the cable 52 and hence the print element carrier 41 in a printing direction or in a line return direction. The print element carrier 41 is supported for escapement motion by two parallel support rails 57 and 59.

Figure 2:
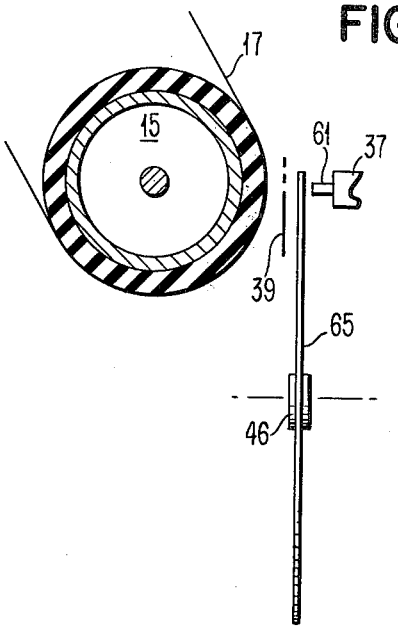
FIG. 2 PRIOR ART
FIG. 2 is a schematic illustration of a prior wheel printing system.

Referring now to FIG. 2 of the drawing, there is depicted a schematic illustration of a prior wheel printing system. The printing system includes a platen 15 having a sheet of paper 17 wrapped thereabout, a print hammer mechanism 37, a print ribbon 39, and a print wheel 65. When printing takes place, the print ribbon 39 is lifted to the phantom line position and the print hammer mechanism 37 is energized causing the hammer 61 to move leftward as viewed striking a selected print spoke and causing it in turn to strike the print ribbon 39. The print spoke and print ribbon then impact a sheet of paper 17 on the platen 15 causing a character to be printed. Once the print hammer 61 has cleared the print wheel 65, the print wheel may be rotated to select another print spoke so that a subsequent symbol can be printed on the next operating cycle.

Figure 3:
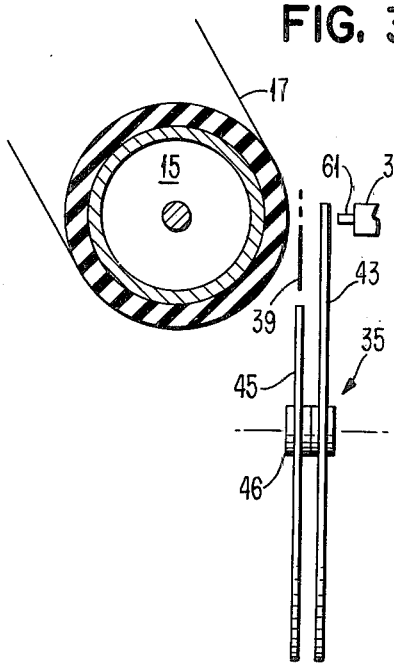
FIG. 3 is a schematic illustration of the coaxially mounted print wheel printing system of the present invention.

Referring now to FIG. 3 of the drawing, a schematic illustration of the coaxially mounted print wheel printing system of the present invention is depicted. The print element 35 includes the front print wheel 43 and the rear print wheel 45. The rear print wheel 45 has been rotated so that its gap is aligned with the print position. As thusly positioned, the rear print wheel is essentially located in the dead space directly below the print ribbon 39 and does not affect the operation of the front print wheel 43. The front print wheel 43 is positioned exactly as the print wheel 65 of FIG. 2 with respect to the platen 15 and the print hammer mechanism 37 and printing is effected in the same manner. In order to effect character selection on successive printing cycles, the front print wheel 43 is rotated while the rear print wheel 45 remains fixed in the position depicted.

Figure 4:
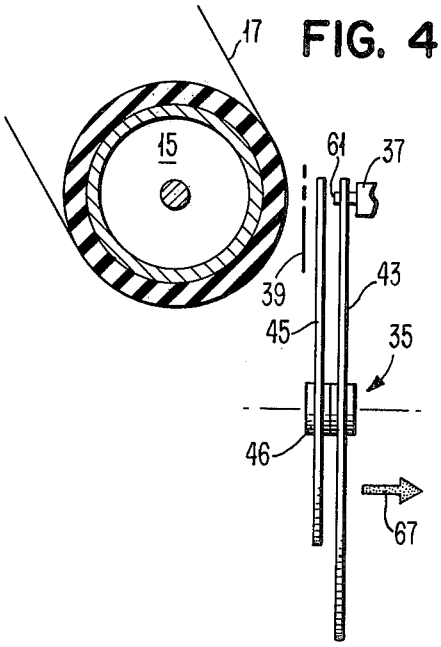
FIG. 4 is a schematic illustration of the coaxially mounted print wheel printing system of the present invention when spacially shifted.

Referring now to FIG. 4 of the drawing, a schematic illustration of the coaxially mounted print wheel printing system of the present invention when spacially shifted is depicted. As thusly shifted, the front print wheel 43 has been rotated so that its gap aligns with the print hammer mechanism 37 and the print position. The print element 35 has been axially shifted in the direction of arrow 67 from the position depicted in FIG. 3 by a distance corresponding to the distance between the front print wheel 43 and the rear print wheel 45. Further, the print wheel 45 has been rotated 180° from the position depicted in FIG. 3 in order to select a particular print spoke. As thusly positioned, actuation of the print hammer mechanism 37 causes the print hammer 61 which is now located in the gap of the front print wheel 43 to strike a selected print spoke of the rear print wheel 45 causing that print spoke to impact the print ribbon 39 and paper 17. Print character selection from the rear print wheel 45 is effected by rotating the rear print wheel 45 while maintaining the position of the front print wheel 43. It is noted that the distance between the print hammer mechanism 37 and the print wheel utilized to effect printing remains constant. Further, the distance between the selected print spoke and the print ribbon 39 as well as the distance between the selected print spoke and the platen 15 remains constant. Thus, the same print hammer mechanism 37 as was used in the prior art could be employed with the present invention. Further, as will be subsequently described, the prior art character selection mechanism could be employed since the number of print spokes and their relative positions on each print wheel 43, 45 could be the same as on the prior print wheel 65.

Figure 5:
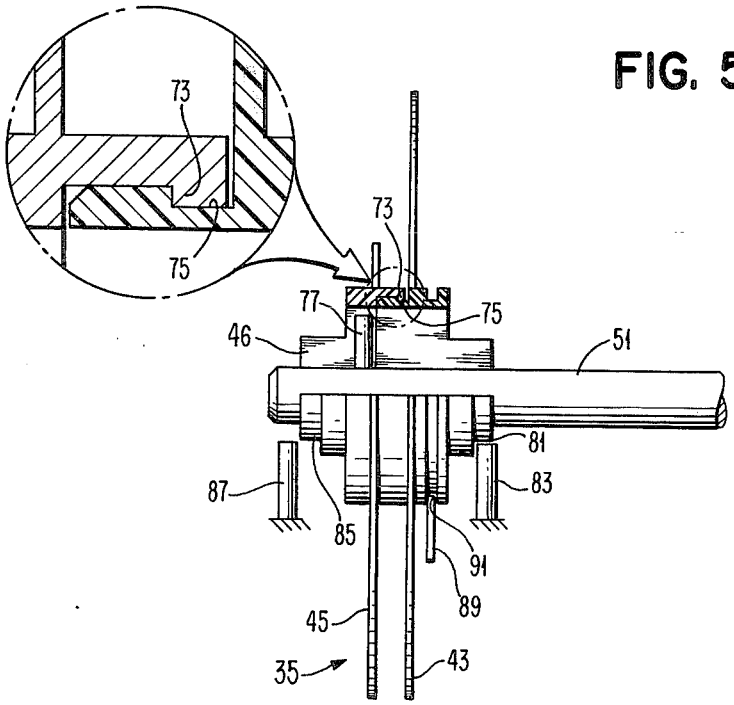
FIG. 5 is a side sectional view of the print wheels located on the print shaft when printing from the rear print wheel.

Referring now to FIG. 5 of the drawing, a side sectional view of the print wheels located on the print shaft when printing from the rear print wheel is depicted. The two print wheels 43, 45 are made from the flexible plastic material utilized to make prior print wheels such as those employed with the Qume Q Series printers presently manufactured by the Qume Corporation of Hayward, Calif. The two print wheels 43 and 45 are held together as an assembly by an annular lip or pawl type cross-section 73 on the rear print wheel 45 which snaps into engagement with an annular groove 75 in the front print wheel 43. This arrangement allows the rotation of each print wheel relative to the other and does permit, if necessary, the manual separation of the print wheels 43, 45 with a substantial force level that would be greater than that encountered in normal machine operation.

The print element 35 comprising both print wheels 43 and 45 slides freely on the print shaft 51. Attached to the print shaft 51 is a driving abutment, drive pin 77, which selectively engages an axial slot 79 in the rear print wheel 45 (see FIG. 6) when the print element 35 is positioned for printing from the rear print wheel. The drive pin 77 engages a similar slot (not shown) in the front print wheel 43 when the print element 35 is shifted on shaft 51 to the left as viewed in FIG. 5 so as to print from the front print wheel 43. Rotation of the print shaft 51 thus effects rotary movement of the print wheel 45 through the drive pin 77 when the print element 35 is positioned as depicted in FIG. 5. In order to prevent the front print wheel 43 from rotating with the rear print wheel 45, a flat 81 on the hub of the front print wheel 43 engages a fixed stop 83. Similarly, when the print element 35 is shifted leftward on the print shaft 51 in order to print from the front print wheel 43, a flat 85 (see also FIG. 6) on the hub of the rear print wheel 45 engages a fixed stop 87. The rear print wheel 45 is thusly prevented from rotating when the drive pin 77 drives the front print wheel 43. By rotating only one print wheel at a time to achieve character selection, the inertia of the selection system approximates that of the single wheel prior printer systems.

A shift arm 89 engages an annular slot 91 located in the front print wheel 43. Leftward movement of the shift arm 89 effects corresponding displacement of the print element 35 along shaft 51. Once the print element 35 is so shifted, it may be returned to its rightmost position by return movement of the shift arm 89. When such shifting occurs, it is necessary that the print wheels each be located at their home position so that the drive pin 77 aligns with the axial slot 79 in the rear print wheel 45 and with a similar slot (not shown) in the front print wheel 43.

Figure 6:
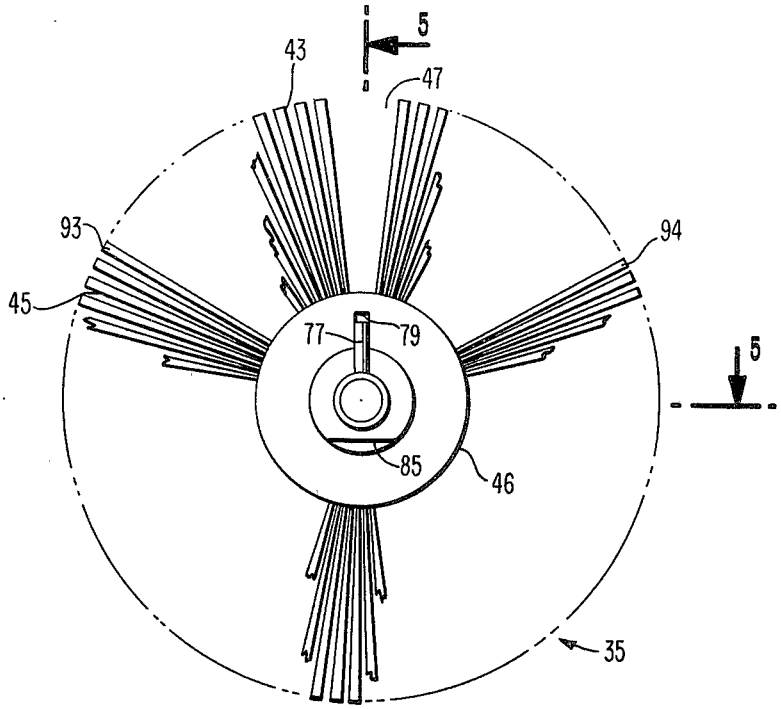
FIG. 6 is a view of the print wheels as viewed from the platen.

Referring to FIG. 6 of the drawing, a view of the print wheels as viewed from the platen of the printer is depicted. The rear print wheel 45 is thus located on top of the front print wheel 43 as viewed and both print wheels have been rotated to their home position wherein the drive pin 77 aligns with the axial slot 79 in the rear print wheel 45 and with a similar slot (not shown) in the front print wheel 43. As thusly positioned, it can be seen that the gap 47 of the front print wheel 43 is of sufficient size to allow entry by the print hammer 61 of FIG. 3 in order to print from the rear print wheel 45. The gap between the print spokes 93 and 94 of the rear print wheel 45 is substantially larger than the gap 47 in order to permit location of the print ribbon 39 of FIG. 1 thereabove when printing from the front print wheel 43. (See also FIG. 3). It is noted that this gap could be reduced in size if the ribbon location is shifted closer to the platen or is constantly maintained in a raised position. It is necessary that the gap be of sufficient size to allow the selected print spoke of the front print wheel 43 to enter therethrough in order that it strike the platen.

It will be noted that the home position for each wheel aligns the drive pin 77 with its associated slot. Further, the gap of each print wheel is aligned with the print hammer and print position.

Figure 7:
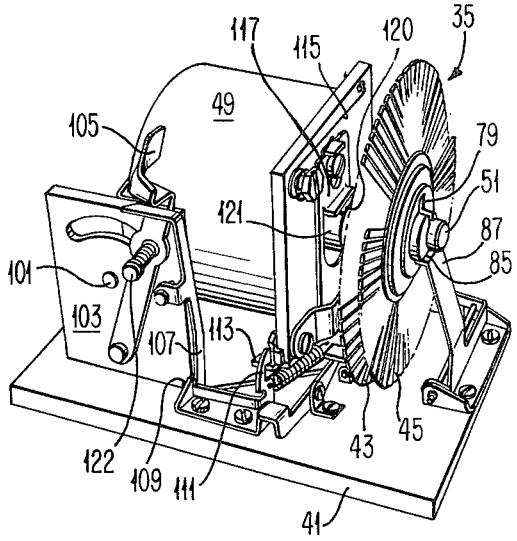
FIG. 7 is a perspective sketch of the print element carrier and selection system in its operating position.

Referring now to FIG. 7 of the drawing, a perspective sketch of the print element carrier and selection system in its operating position is depicted. As described heretofore, the print element carrier 41 has a selection motor 49 mounted thereon. The selection motor 49 in turn includes a print shaft 51 on which the print element 35 is mounted. The selection motor 49 controls the rotary position of the print shaft 51 and hence the positioning of a selected print spoke at the print position.

When it is desirous to remove the print element 35 from the print shaft 51 in order to replace it with a different print element, the selection motor 49 is rotated to its home position. The selection motor 49 is then moved about its pivot bar 101 (see also FIG. 1) to the position depicted in FIG. 8. The pivot bar 101 is fixedly secured to the rear of the selection motor 49 and pivots within the mounting bracket 103.

In order to effect movement of the selection motor 49 and the print element 35, an operator controlled handle 105 is provided. Movement of the handle 105 away from the selection motor 49 causes the linkage 107 to move outward, pivoting about its pivot 109, thereby releasing the latching surface 111 from the latch keeper 113 which is secured to the selection motor 49. The spring 115 acts against the slider 117 pushing it downward against the curved lip 119 (see FIG. 8) of the mounting bracket 103 thereby lifting the latch keeper 113 above the latching surface 111 of the linkage 107. The downward motion of the slider 117 also causes it to act against a flat surface 120 on the collar 121 attached to the print shaft 51 thus preventing rotation of the print shaft from its home position. The handle 105 is then moved leftward as viewed in FIG. 7 and acts upon pin 122 secured to the selection motor 49 to thereby cause the selection motor 49 and print element 35 to pivot upward about the pivot bar 101.

Figure 8:
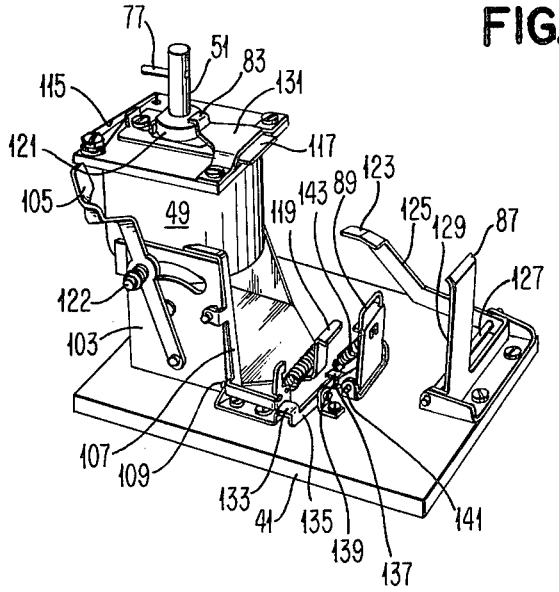
FIG. 8 is a perspective sketch of the print element carrier and selection mechanism in its operator loading position.

Referring now to FIG. 8 of the drawing, a perspective sketch of the print element carrier and selection mechanism in its operator loading position is depicted. The print element 35 of FIG. 7 has been removed from the print shaft 51 exposing the drive pin 77 for view. In order for the print element 35 to clear the fixed stop 87 as it rotates about the pivot bar 101 of FIG. 7, the fixed stop 87 is moved forward during this rotational movement. The selection motor 49 rests upon the surface 123 of the linkage 125 when in its operational position. As the selection motor 49 is pivoted away from its operational position, a spring (not shown) located on the pivot shaft 127 acts against the back surface 129 of the fixed stop 87 causing it to move away from the selection motor 49. When the selection motor 49 is lowered back to its operational position, it pushes downward on the surface 123 causing the fixed stop 87 to move against the bias of the spring (not shown) and pivot toward the selection motor 49 about the pivot shaft 129 to assume its operational position. It should be noted that the fixed stop 87 remains fixed as long as the selection motor 49 remains in its operative position as depicted in FIG. 7.

The fixed stop 83 which co-acts with the front print wheel 43 is fixedly secured to the selection motor 49 as it forms a part of the bracket 131.

As described heretofore, a shift arm 89 acts upon the print element 35 of FIG. 7 to cause it to move axially along the print shaft 51. Motion of a solenoid plunger (not shown) against the surface 133 of linkage 135 causes it to pivot about the pivot 137 thereby lifting up under the tab 139. Upward movement of the tab 139 which is secured to the shift arm 89 causes the shift arm 89 to pivot in a clockwise direction about the pivot 141 as viewed and against the bias of the spring 143. This motion causes the print element 35 of FIG. 7 to move away from the selection motor 49 along the print shaft 51. Release of the solenoid force against the surface 133 allows the spring 143 to return the print element 35 to its position closest to the selection motor 49.

As described heretofore, characters may be entered from a keyboard such as keyboard 19 of FIG. 1 or other character entry means including communication channels or storage devices such as magnetic media. When utilizing keyboard entry, it is desirous to place characters encountered in preparing typical documents all on one print wheel, such as the front print wheel 43. Characters less often encountered such as, for example, Greek symbols, may be placed on the secondary print wheel such as the rear print wheel 45. Thus, during normal typing operations, all characters would be selected from the front print wheel thereby allowing maximum throughput speed. When a special character is to be selected, the secondary print wheel is selected. This latter selection process is still much quicker and easier for operators than the prior art approach of changing print wheels. Since most keyboards are built for selecting approximately 100 characters (utilizing the shift key), it is necessary to add an additional code key to such standard keyboards thereby providing a third shift level in order to effect selection of additional characters which are located on the secondary or rear print wheel 45.

Figure 9:
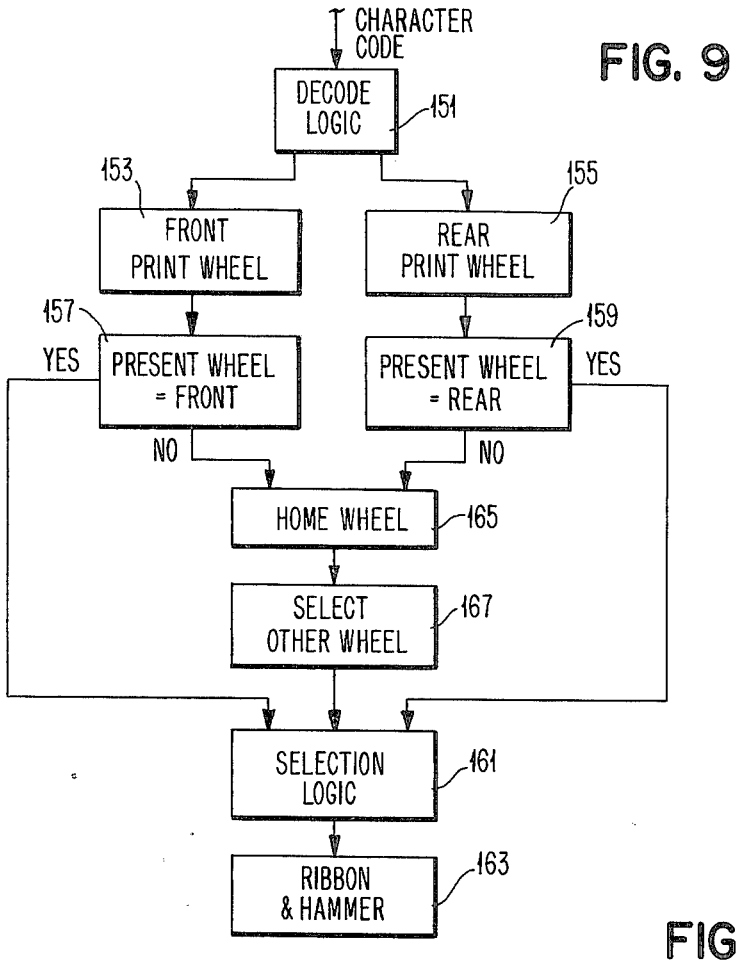
FIG. 9 is a logic flow diagram of the print wheel selection logic of the present invention.

Referring now to FIG. 9 of the drawing, a logic flow diagram of the print wheel selection logic of the present invention is depicted. Keybutton depression results in the generation of a character code representing a unique character spoke on one of the two print wheels 43, 45 of FIG. 1. This character code is provided to decode logic 151 which provides an output signal as indicated by blocks 153 and 155 specifying whether the character is located on the front print wheel 43 of FIG. 1 or the rear print wheel 45 of FIG. 1. If, as is indicated by the YES paths from blocks 157 and 159, the wheel location of the selected character matches the present wheel position, the selection logic 161 is energized causing the selection motor 49 of FIG. 1 to rotate the selected print wheel so that the print spoke thereof corresponding to the selected character aligns with the print hammer mechanism 35 of FIG. 1. Once the desired print spoke is thusly positioned, the print ribbon 39 is raised to its printing position and the print hammer mechanism 35 is energized to effect printing as indicated by block 163.

If the output of the decode logic 151 indicates that the wheel location of the selected character does not match the present wheel position, the NO outputs of blocks 157 and 159 so indicate.

The print element 35 is then brought to its home position as indicated by block 165. The print wheel selection logic is next energized to cause the print element 35 of FIG. 1 to move on the print shaft 51 so that the other print wheel is selected for rotation as indicated by block 167. The selection logic 161 then causes the selected print spoke to align with the print position as previously described.

Figure 10:
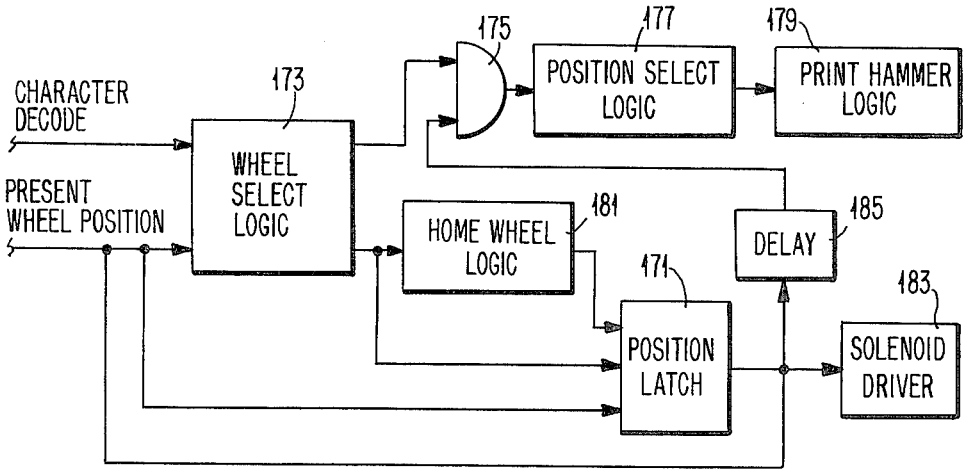
FIG. 10 is a block diagram of the print wheel selection control logic.

Referring now to FIG. 10 of the drawing, a block diagram of the print wheel selection control logic is depicted. This print wheel selection control logic controls which of the print wheels, 43 or 45 of FIG. 1 is selected for printing and which of the print wheels is aligned so that its gap aligns with the print position and hammer. As described heretofore, the character code from a keyboard or other apparatus is decoded to determine whether that character is located on the front print wheel 43 or rear print wheel 45 of FIG. 1. The present print wheel position as supplied from the position latch 171 and the character decode signal are provided to wheel select logic 173. This logic comprises simple combinational circuit elements which provide an output signal either indicating that the correct wheel is in position for character selection or indicating that the wheel position must be changed. If the correct wheel is in position, a signal is supplied to the OR gate 175 and thence to the position select logic 177. The position select logic 177 may be identical to that employed in present printers such as Qume Q Series Printers. This logic includes a character counter which maintains the present rotary position of the print wheel and logic including storage latches which indicate the desired position of the selected character. The motor 49 of FIG. 1 which may be the same servo motor as employed with the Qume printer is then rotated until the correct print spoke is aligned with the print hammer and print position. An optical transducer provides feedback pulses indicating the degree of rotation of the servo system. The same print hammer and print ribbon logic as is employed with the Qume Q Series printers may also be employed to effect printing of the appropriate character. This logic is indicated by block 179.

When the wheel select logic 173 indicates that the selected print wheel must be changed, the presently selected print wheel is brought to its home position as indicated by block 181. The print wheel may be thusly homed by utilizing the present position select logic of the Qume Q Series printer. This is accomplished by loading the home location into the desired character position storage latches thereby causing the servo motor to rotate to the home position. An inhibit signal is provided to the ribbon logic and hammer logic to prevent a print cycle from occurring. Once the previously selected print wheel is located in its home position, a signal is provided to the position latch 171 which also receives a feedback signal and a signal from the wheel select logic 173 indicating that the wheel position must be changed. The position latch is a bistable device which assumes its opposite state when the wheel select logic 173 and the home wheel logic 181 provide output signals thereto. When the position latch 171 changes states, it causes a signal to be applied to the solenoid driver 183 which in turn causes a solenoid (not shown) to act on surface 133 of linkage 135 in FIG. 8 causing the shift arm 89 to reposition the print element 35. The output signal from the position latch 171 is delayed by delay 185 in order to insure that the wheel is correctly positioned prior to that signal being applied to the OR gate 175 and thence to the position select logic 177. Once the position select logic 177 receives that signal, it is responsive to the character code to effect rotation of the newly selected print wheel to its correct position. Thereafter, the print hammer logic 179 effects the printing as heretofore described.

Operation

Referring once again to FIG. 1 of the drawing, a printer having additional character selection capacity over those of the prior art is depicted. Characters entered by the keyboard 19 cause the print element 35 to rotate to align a single corresponding print spoke with the print hammer mechanism 37. Thereafter, the print hammer mechanism is actuated to drive the selected print spoke into the print ribbon 39 thence into the paper 17 on the platen 15 to create an image at the print position on the paper 17. The print element carrier 41 is then moved to align the selected spoke of the print element 35 at the next print position on the paper 17. Once a line of printing has been completed, the platen 15 is rotated or indexed in order to align a new line of print positions on the paper 17 with the moving print element 35. It is noted that the print element 35 may print from left to right as with conventional typewriters or bidirectionally when utilized as an output printer.

With reference to FIG. 7 of the drawing, the print element 35 includes a front print wheel 43 and a rear print wheel 45. When printing from the front print wheel 43, the rear print wheel 45 is positioned in a home position as depicted leaving a gap through which the print spoke located at the twelve o'clock position of the front print wheel 43 may pass in order to print. The fixed stop 87 prevents the rear print wheel 45 from rotating with the print shaft 51 as it in turn rotates to turn the front print wheel 43 for character selection. In a similar fashion, a gap (not shown) of the front print wheel 43 may be aligned at the twelve o'clock position while the rear print wheel 45 is rotated to align a selected print spoke at the twelve o'clock position. Printing is thus effected when the print hammer (not shown) passes through the gap in the front print wheel 43 striking the selected print spoke of the rear print wheel 45.

While the invention has been described with respect to a print element having two spoked print wheels, it is recognized that further print wheels could be employed in the same fashion to achieve additional character selection while maintaining or reducing the inertia of the print wheel selection system. That is, for example, three print wheels could be located on the print shaft 51, each of the print wheels having gaps associated therewith and a corresponding stop associated therewith. The two non-selected print wheels would be positioned with their gaps aligned with the print hammer while the selected wheel would be rotated to align the desired print spoke with the hammer position. The print wheels would be shifted axially to maintain the distance between the selected print spoke, the hammer, and the platen constant.

Further, the print element could take the form of cupped shaped spoke print elements instead of wheel shaped spoked print elements. Such cupped shaped spoked print elements would be concentrically mounted on a vertical print shaft as is the case with present day printers employing such print elements. The vertical shaft would then be shifted toward or away from the platen depending upon which print element was selected. Each such print element would have a gap, that of the outer print element being sized to allow print spoke entry and that of the inner print element being sized to allow print hammer entry.

Numerous minor changes of form and construction could also be employed without changing the substance of the invention. For example, simple part reversals could be made such as reversing the drive pin 77 and slot 79 drive arrangement of FIG. 6 to include a drive slot on the print shaft 51 and a driven pin on the print element 35. Different couplings such as using a magnetic coupling instead of the pawl 73-groove 75 coupling could be employed.

While the invention has been particularly shown and described with reference to the preferred embodiment thereof, it will be understood by those skilled in the art that the foregoing and other changes in form and detail may be made therein without departing from the spirit and scope of the invention.

What is claimed is:

1. A printer including:

a platen for retaining a document;

a print element spaced from the platen having plural print spokes thereon each being movable toward the platen to impact the platen at a print position, the print element and the platen being mounted for relative motion with respect to one another to vary the print position in at least two directions;

a hammer for driving a selected one of said print spokes to impact said platen at said print position;

said print element comprising a first print wheel having a plurality of print spokes having character type faces thereon extending from a hub and having a gap between at least two print spokes dimensioned to allow entry therethrough of the hammer, said first print wheel being mounted for rotation about an axis thereof so that each print spoke may be selectively aligned with the print position, and a second print wheel having a plurality of print spokes having character type faces thereon extending from a hub and having a gap between at least two print spokes dimensioned to allow entry therethrough of at least one print spoke of said first print wheel, said second print wheel being mounted coaxially with said first print wheel for rotation about an axis thereof so that each print spoke thereof may be selectively aligned with said print position, said first and second print wheels being mounted for rotation relative to one another;

character selection means for selectively rotating a selected one of said print wheels to align the gap thereof with the hammer at the print position and for rotating the other of said print wheels relative to the selected one of said print wheels to align a selected print spoke of the other of said print wheels with said hammer at said print position; and actuation means responsive to the character selection means for actuating the hammer to drive the selected print spoke to impact the platen at the print position with the character type face thereof to effect printing on the document.

2. The printer set forth in claim 1 wherein said character selection means includes:

a rotary shaft for imparting rotary motion to said print wheels;

said print wheels each being coaxially mounted on said shaft and axially movable thereon;

a shifting means for shifting a selected one of said print wheels axially along said shaft from a first inoperative position to a second operative position and for shifting the other of said print wheels from said second operative position.

3. The printer set forth in claim 2 wherein said rotary shaft includes a drive abutment which selectively engages a drive slot in the print wheel located at said second operative position for imparting rotary motion thereto.

4. The printer set forth in claim 2 or claim 3 wherein said character selection means further includes stop means for engaging said print wheels when positioned at their inoperative position to prevent rotation thereof as said shaft imparts rotary motion to the other of said print wheels.

5. The printer set forth in claim 4 wherein said stop means includes a first stop for engaging said first print wheel when said second print wheel has rotary motion imparted thereto and a second stop for engaging said second print wheel when said first print wheel has rotary motion imparted thereto.

6. The printer set forth in claim 5 wherein each print wheel has a flat surface at the hub thereof for engaging its associated stop.

7. The printer set forth in claim 2 wherein said gap of said second print wheel allows passage of said print ribbon thereover when said second print wheel is in its inoperative position.

8. The printer set forth in claim 2 wherein said first print wheel and said second print wheel are joined together at the hubs thereof so as to allow relative rotary motion and joint axial motion.

9. The printer set forth in claim 1, 2 or 8 wherein said first print wheel and said second print wheel are joined by an annular lip on the hub of one of said print wheels and a mating annular groove on the hub of the other of said print wheels.

10. A spoked wheel printer having a spoked print element and a print hammer for driving a selected spoke to impact a medium at a print position including:

a rotary shaft for mounting said print element thereon, said shaft having a print wheel engaging means thereon;

said spoked print element comprising a first print wheel and a second print wheel each having plural character bearing print spokes extending radially from a hub thereof and each having a gap between at least two adjacent print spokes of sufficient size to allow entry of a print spoke therebetween, each of said print wheels further including a driven surface for selective engagement with said print wheel engaging means;

print wheel selection means for axially moving said print wheels along said shaft so that the driven surface of a selected print wheel is driven in rotation with said rotary shaft by said print wheel engaging means;

stop means for preventing rotation of the non-selected print wheel during rotation of the selected print wheel;

control means for controlling said print wheel selection means and said rotary shaft to position the gap of the non-selected print wheel and a selected print spoke of the selected print wheel adjacent said print hammer and said print position.

11. The spoked wheel printer set forth in claim 10 wherein said stop means includes a first stop for engaging the first print wheel when said second print wheel has rotary motion imparted thereto by said print wheel engaging means and a second stop for engaging said second print wheel when said first print wheel has rotary motion imparted thereto by said print wheel engaging means.

12. The spoked wheel printer set forth in claim 11 wherein each print wheel has a flat surface at the hub thereof for engaging its associated stop.

13. The spoked wheel printer set forth in claim 10 wherein said first print wheel and said second print wheel are joined together at the hubs thereof so as to allow relative rotary motion and joint axial motion.

14. The spoked wheel printer set forth in claim 10 or 13 wherein said first print wheel and said second print wheel are joined by an annular lip on the hub of one of said print wheels and a mating annular groove on the hub of the other of said print wheels.

15. The spoked wheel printer set forth in claim 10 wherein said print wheel engaging means includes a drive abutment secured to said shaft and wherein the driven surface of each print wheel includes a slot through which said drive abutment moves as said print wheels are shifted axially by said print wheel selection means.

16. A spoked printer having a single print hammer actuable to drive a selected print spoke into a medium at a print position comprising:

a first print element having plural character bearing print spokes extending from a central area thereof, at least two of said adjacent print spokes having a gap therebetween dimensioned to allow entry therethrough of the hammer, said first print element being mounted for rotation about an axis thereof so that print spokes may be selectively aligned with the hammer and print position;

a second print element having plural character bearing print spokes extending from a central area thereof, at least two of said adjacent print spokes having a gap therebetween dimensioned to allow entry therethrough of a print spoke of said first print element, said second print element being mounted for rotation about an axis thereof so that print spokes may be selectively aligned with the hammer and print position;

character selection means for selectively rotating a selected one of said print elements to align the gap thereof with the hammer at the print position and for rotating the other of said print elements relative to the selected one of said print elements to align a selected print spoke of the other of said print elements with said hammer at said print position;

actuation means responsive to the character selection means for actuating the hammer to drive the selected print spoke to impact the medium at the print position.

17. A print element for a spoked printer comprising:

a first print element having plural character bearing print spokes extending from a central area thereof, at least two of said adjacent print spokes having a gap therebetween dimensioned to allow entry therethrough of a print hammer, said first print element having an axial opening through said central area;

a second print element having plural character bearing print spokes extending from a central area thereof, at least two of said adjacent print spokes having a gap therebetween dimensioned to allow entry therethrough of a print spoke of said first print element, said second print element having an axial opening through the central area thereof;

said first print element and said second print element being joined together at the central area thereof by an annular lip on the central area on one of said print elements and a mating annular groove on the central area on the other of said print elements, the axial openings of said print elements, said annular lip and said annular groove being coaxial.

18. The device set forth in claim 16 or 17 wherein said first print element and said second print element each comprise print wheels having print spokes extending radially from the central area thereof.

19. The device set forth in claim 18 wherein each print wheel has a flat surface on a hub in the central area thereof for engaging a stop.

20. The device set forth in claim 18 wherein each print wheel includes a slot for receiving a drive abutment therein.

* * * * *